US009321279B2

(12) United States Patent
Torii

(10) Patent No.: US 9,321,279 B2
(45) Date of Patent: Apr. 26, 2016

(54) TAPE PRINTER FOR FORMING SELF-LAMINATING LABEL, TAPE CASSETTE AND INK RIBBON THEREFOR

(71) Applicant: Brother Kogyo Kabushiki Kaisha, Nagoya-shi, Aichi-ken (JP)

(72) Inventor: Yasuhiro Torii, Okazaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/673,951

(22) Filed: Mar. 31, 2015

(65) Prior Publication Data

US 2015/0375527 A1 Dec. 31, 2015

(30) Foreign Application Priority Data

Jun. 30, 2014 (JP) ..... 2014-134481

(51) Int. Cl.

| | |
|---|---|
| ***B41J 3/407*** | (2006.01) |
| ***B41F 17/00*** | (2006.01) |
| ***B41J 2/325*** | (2006.01) |
| ***B41J 15/04*** | (2006.01) |
| ***B65C 1/00*** | (2006.01) |
| ***B31D 1/02*** | (2006.01) |
| ***B65C 3/02*** | (2006.01) |
| ***B65C 11/02*** | (2006.01) |

(52) U.S. Cl.

CPC ..... *B41J 3/4075* (2013.01); *B31D 1/021* (2013.01); *B41J 2/325* (2013.01); *B41J 15/044* (2013.01); *B65C 1/00* (2013.01); *B65C 3/02* (2013.01); *B65C 11/02* (2013.01); *B41F 17/00* (2013.01); *B65C 2210/0054* (2013.01)

(58) Field of Classification Search

CPC combination set(s) only.
See application file for complete search history.

(56) References Cited

U.S. PATENT DOCUMENTS

| | | | | |
|---|---|---|---|---|
| 4,927,278 | A * | 5/1990 | Kuzuya et al. | 400/208 |
| 2002/0154933 | A1 | 10/2002 | Kalette | |
| 2007/0006963 | A1 * | 1/2007 | Bever | 156/213 |
| 2009/0277570 | A1 | 11/2009 | Caveney et al. | |

(Continued)

FOREIGN PATENT DOCUMENTS

| | | | |
|---|---|---|---|
| JP | 2011-524154 | A | 8/2011 |
| WO | 2009/137756 | A1 | 11/2009 |

*Primary Examiner* — Huan Tran
(74) *Attorney, Agent, or Firm* — Banner & Witcoff, Ltd.

(57) ABSTRACT

A tape printer with a thermal head and a tape cassette for forming a self-laminating printed label: wherein the tape cassette comprises; an ink ribbon including a print ink layer formed from opaque ink, a transparent ink layer formed from transparent ink and a longitudinal film base, the print ink layer and the transparent ink layer being coated on the film base in a longitudinal direction of the film base; a print tape including a longitudinal transparent film portion with a first surface side and a second surface side opposite to the first surface side, the opaque ink of the print ink layer and the transparent ink of the transparent ink layer being transferred to the first surface side of the transparent film portion from the ink ribbon; wherein, in the print tape, a transparent adhesive layer is coated on the second surface side of the transparent film portion, the opaque ink of the print ink layer is transferred on a first end side of the first surface side of the transparent film portion in a width direction from the ink ribbon and the transparent ink of the transparent ink layer is transferred on a second end side of the transparent film portion opposite to the first end side from the ink ribbon, and wherein the thermal head operates to transfer both the opaque ink of the print ink layer and the transparent ink of the transparent ink layer on the print tape from the ink ribbon.

12 Claims, 8 Drawing Sheets

(56) References Cited

U.S. PATENT DOCUMENTS

2011/0268897 A1 11/2011 Klemann
2012/0308756 A1 12/2012 Caveney et al.
2013/0342623 A1* 12/2013 Boot et al. ..... 347/110
2013/0342856 A1* 12/2013 Boot et al. ..... 358/1.6
2014/0226169 A1* 8/2014 Jacobs et al. ..... 358/1.2
2015/0007929 A1 1/2015 Caveney et al.
2015/0251464 A1* 9/2015 Kubota et al. ..... B41J 15/044

* cited by examiner

TAPE PRINTER FOR FORMING SELF-LAMINATING LABEL, TAPE CASSETTE AND INK RIBBON THEREFOR

CROSS REFERENCE TO RELATED APPLICATIONS

The present application claims priority from Japanese Patent Application No. JP 2014-134481, which was filed on Jun. 30, 2014, the disclosure of which is incorporated herein by reference it its entirety.

TECHNICAL FIELD

The present disclosure relates to a tape printer for forming a self-laminating printed label, a tape cassette utilized when the self-laminating printed label is formed in the tape printer and an ink ribbon used in the tape cassette.

BACKGROUND

Conventionally, it is proposed a print medium for forming a self-laminating printed label. As such a print medium, for example, it is known a tape-like print medium.

Furthermore, as the tape-like print medium, for example, it is known a print tape. The print tape is accommodated in a tape cassette utilized for forming a self-laminating printed label with a longitudinal ink ribbon. In the print tape, a printing part is formed adjacent to a transparent film part along a longitudinal direction of the print tape.

In the tape printer in which the above tape cassette is set, printing is conducted on the print tape by a thermal head installed in the tape printer. Thereafter, the print tape on which printing is conducted is cut. Thereby, the self-laminating printed label is formed.

The self-laminating printed label is wound around a wire cable. When the self-laminating printed label is wound, the printed printing part thereof is adhered on the wire cable and is continuously wound around the wire cable while the transparent film part thereof is overlapped with each other. Thereby, the printed printing part is covered by the transparent film part. That is to say, the printed printing part on the wire cable is laminated by the transparent film part.

However, when the print tape and the ink ribbon are fed along the longitudinal direction thereof in the tape cassette, the ink ribbon tends to vibrate in the width direction thereof.

The reason is due to that the print tape has the printing part only on the half side along the width direction thereof and the thermal head prints only on the printing part existing on the half side.

In detail, the ink ribbon is sandwiched between the print tape and the thermal head when printing. Further, adhering and releasing of the print tape to the ink ribbon are repeated by heating of the thermal head. Accordingly, force repeatedly occurs on the ink ribbon due to adhering and releasing of the print tape. Therefore, due to such force, the ink ribbon is fed while vibrating in the width direction thereof.

SUMMARY

The present disclosure has been made in taking above problems into consideration and has an object to provide a printer with a tape cassette for forming a self-laminating printed label, in which feed characteristic of an ink ribbon in the tape cassette can be stably retained, a tape cassette and an ink ribbon therefore.

In order to accomplish the above object, according to one aspect of the present disclosure, it is provided a tape printer with a thermal head and a tape cassette for forming a self-laminating printed label: wherein the tape cassette comprises; an ink ribbon including a print ink layer formed from opaque ink, a transparent ink layer formed from transparent ink and a longitudinal film base, the print ink layer and the transparent ink layer being coated on the film base in a longitudinal direction of the film base; a print tape including a longitudinal transparent film portion with a first surface side and a second surface side opposite to the first surface side, the opaque ink of the print ink layer and the transparent ink of the transparent ink layer being transferred to the first surface side of the transparent film portion from the ink ribbon; wherein, in the print tape, a transparent adhesive layer is coated on the second surface side of the transparent film portion, the opaque ink of the print ink layer is transferred on a first end side of the first surface side of the transparent film portion in a width direction from the ink ribbon and the transparent ink of the transparent ink layer is transferred on a second end side of the transparent film portion opposite to the first end side from the ink ribbon, and wherein the thermal head operates to transfer both the opaque ink of the print ink layer and the transparent ink of the transparent ink layer on the print tape from the ink ribbon.

According to another aspect of the present disclosure, it is provided a tape cassette for forming a self-laminating printed label, the tape cassette being set in a tape printer: wherein the tape cassette comprises; an ink ribbon including a print ink layer formed from opaque ink, a transparent ink layer formed from transparent ink and a longitudinal film base, the print ink layer and the transparent ink layer being coated on the film base in a longitudinal direction of the film base; a print tape including a longitudinal transparent film portion with a first surface side and a second surface side opposite to the first surface side, the opaque ink of the print ink layer and the transparent ink of the transparent ink layer being transferred to the first surface side of the transparent film portion from the ink ribbon; wherein, in the print tape, a transparent adhesive layer is coated on the second surface side of the transparent film portion, the opaque ink of the print ink layer is transferred on a first end side of the first surface side of the transparent film portion in a width direction from the ink ribbon and the transparent ink of the transparent ink layer is transferred on a second end side of the transparent film portion opposite to the first end side from the ink ribbon.

According to still another aspect of the present disclosure, it is provided an ink ribbon accommodated in a tape cassette for forming a self-laminating printed label, the ink ribbon comprising: a print ink layer formed from opaque ink; a transparent ink layer formed from transparent ink; and a longitudinal film base; wherein the print ink layer and the transparent ink layer are coated on the film base along a longitudinal direction of the film base.

DETAILED DESCRIPTION

A detailed description of an exemplary embodiment of the disclosure will now be given referring to the accompanying drawings.

[1. Self-Laminating Printed Label]

Figure 1A:
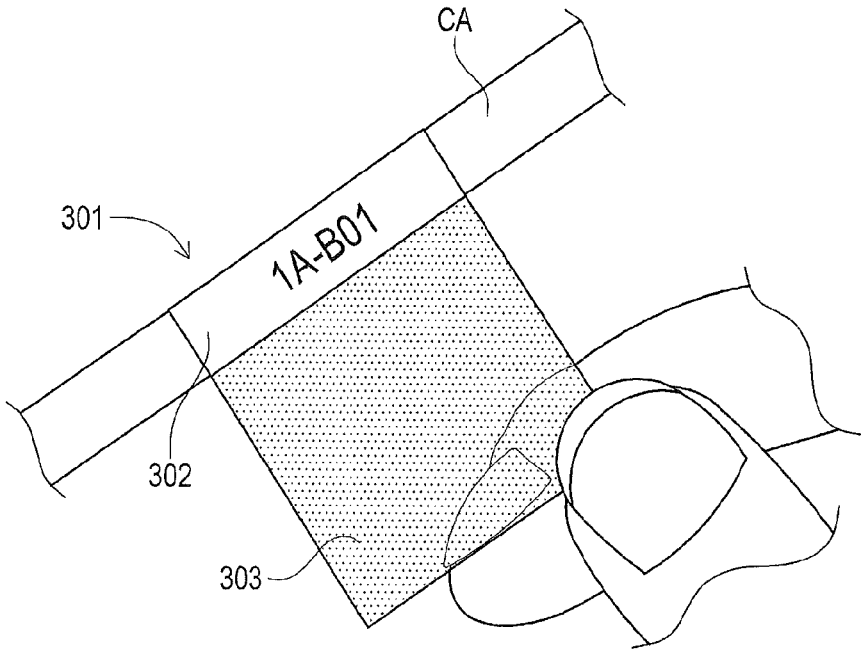
FIGS. 1A and 1B are perspective views to explain a method to use the self-laminating printed label formed from the print tape as a cable indicating label.
Figure 1B:
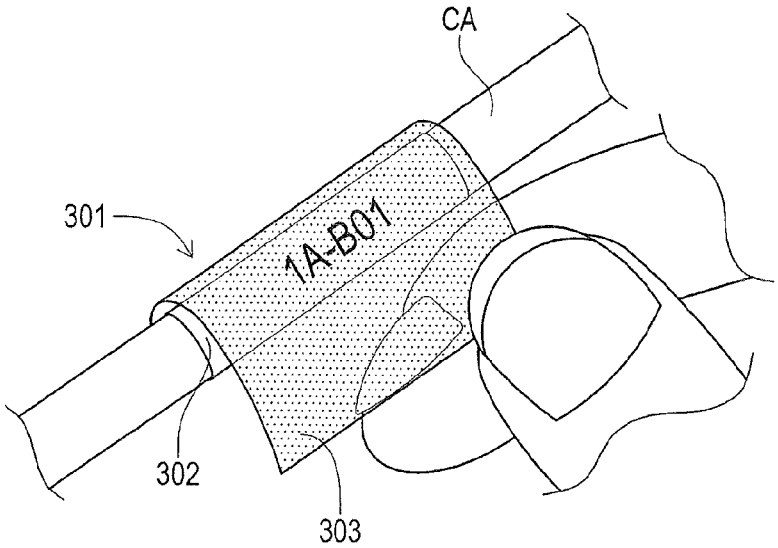

It will be described a method to use the self-laminating printed label formed from the print tape as a cable indicating label. The self-laminating printed label is formed from the print tape. As shown in FIGS. 1A and 1B, in the self-laminating printed label 301, a print part 302 is formed adjacent to a transparent film part 303. Here, a mark [1A-B01] is printed on a surface of the print part 302. A release sheet (not shown) on back surfaces of the print part 302 and the transparent film part 303 is torn, thereby a transparent adhesive layer is exposed.

First, as shown in FIG. 1A, the print part 302 is adhered to a cable CA. Continuously, as shown in FIG. 1B, the transparent film part 303 is wound around the cable CA while being overlapped on the print part 302. Thereby, the print part 302 is laminated on the transparent film part 303. Therefore, in the self-laminating printed label 301, the print part 302 is protected from dusts through the transparent film part 303.

[2. Outline Construction of Tape Printer]

Figure 2:
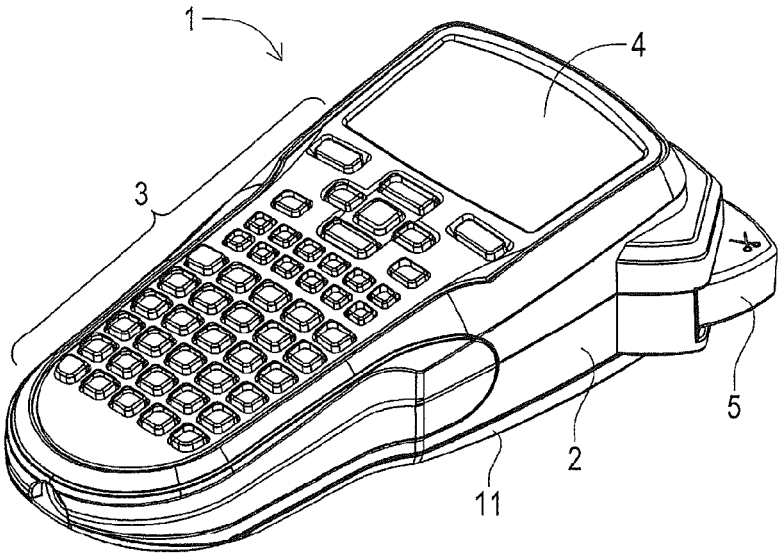
FIG. 2 is an outlined perspective view showing a front side of the tape printer according to the embodiment of the present disclosure.
Figure 3:
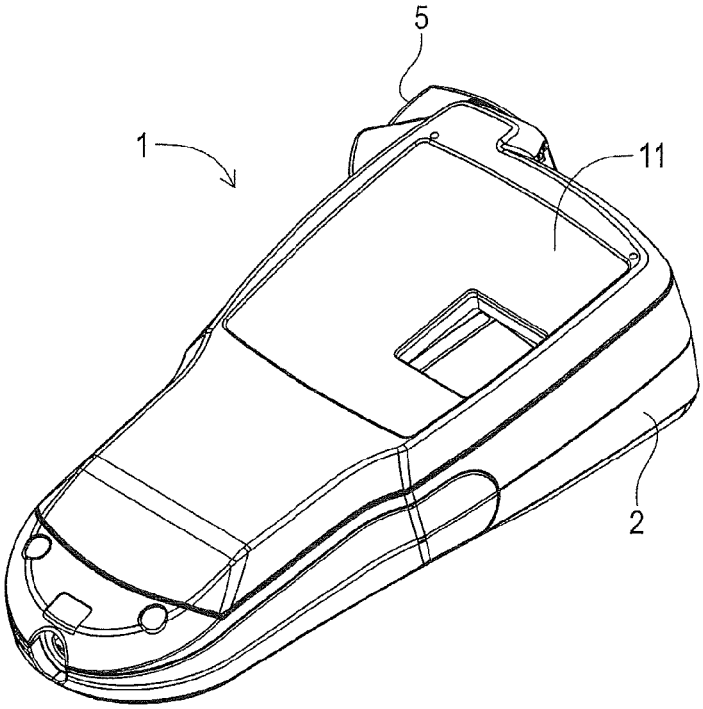
FIG. 3 is an outlined perspective view showing a rear view of the tape printer.
Figure 4:
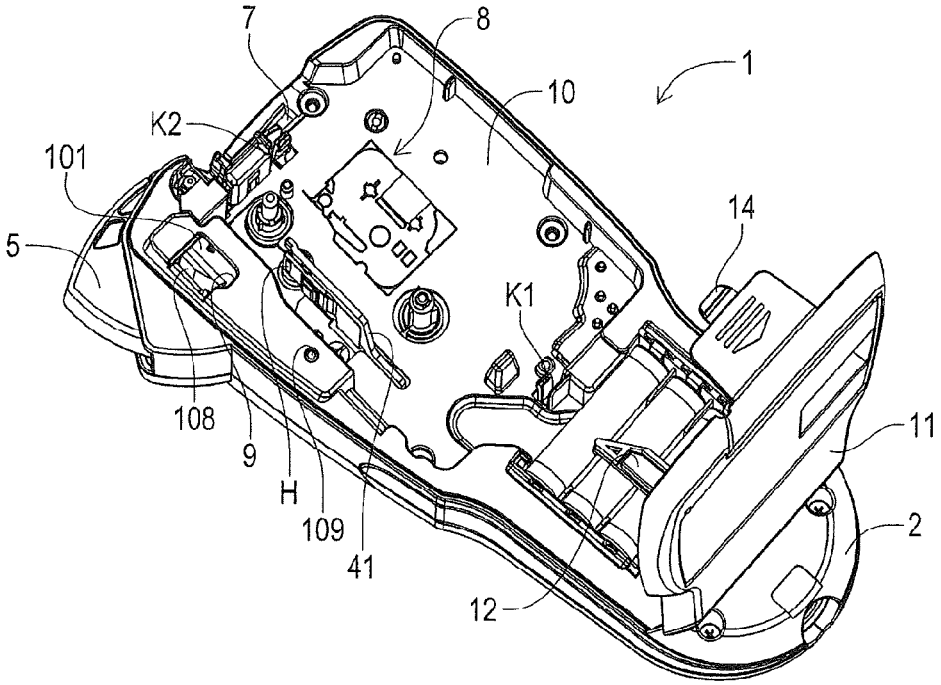
FIG. 4 is an outlined perspective view showing the rear side of the tape printer in which a cover is opened.

Further, the tape printer according to the embodiment of the present disclosure will be described. The tape printer 1 according to the embodiment is utilized to form the self-laminating printed label 301. As shown in FIGS. 2 to 4, in the tape printer 1 according to the embodiment, a key operation part 3, a display 4 and a cutter lever 5 and so on are provided on a main body 2. The key operation part 3 is constructed from a plurality of keys. Further, in the tape printer 1, a cover 11 is attached to the main body 2. The cover 11 is detachable from the main body 2.

In the cover 11, a protrusion 12 and a second engagement hook 14 are provided.

In a state that the cover 11 is opened, as shown FIG. 4, a cassette accommodation part 8 is exposed. The cassette accommodation part 8 is formed on the main body 2 into a concave shape. In the cassette accommodation part 8, an inner accommodation surface 10 is formed. On the cassette accommodation part 8, a pair of engagement portions K1, K2 and a support plate 41 are stood.

Figure 5:
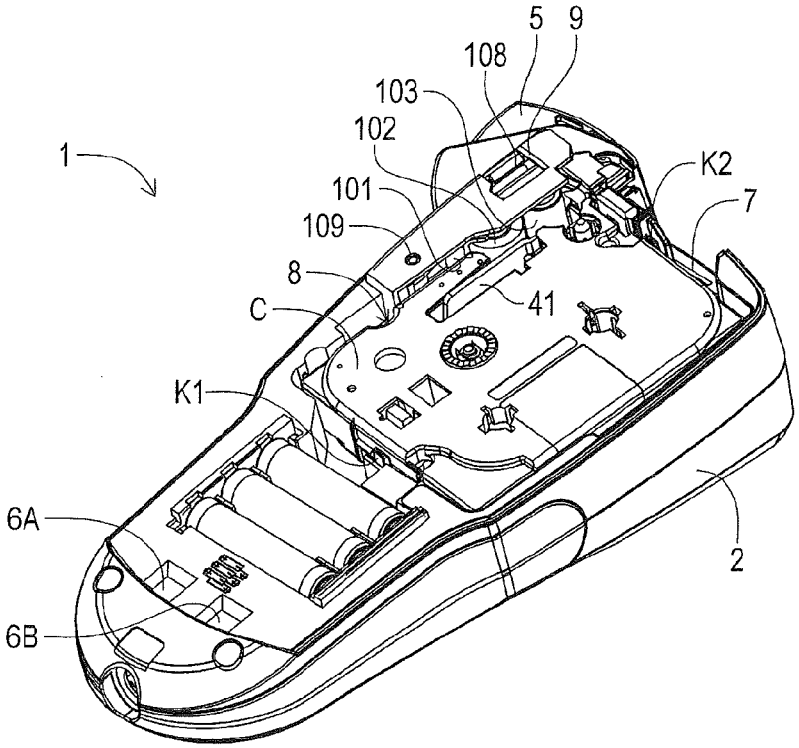
FIG. 5 is an outlined perspective view showing the rear side of the tape printer in which the tape cassette according to the embodiment of the present disclosure for forming the self-laminating printed label is set.

As shown in FIG. 5, the pair of engagement portions K1, K2 are engaged with the surface of the tape cassette C accommodated on the cassette accommodation part 8. Thereby, the tape cassette C is correctly set within the cassette accommodation part 8. At that time, the back surface of the tape cassette C is contacted with the inner accommodation surface 10. As shown in FIG. 4, the thermal head H and so on are attached to the support plate 41.

As shown in FIGS. 4 and 5, a roller holder 101 is provided in the main body 2 near the cutter lever 5. The roller holder 101 is rotatably supported in the main body 2 through a rotation shaft 109. Further, the roller holder 101 is forced by a coil spring (not shown) toward outer side from inner side of the cassette accommodation part 8. In the roller holder 101, a platen roller 102 and a sub-roller 103 are rotatably supported (see FIG. 5).

A pressing surface 108 is formed on the outer surface of the roller holder 101. An inserting and detaching hole 9 is formed in the main body 2. The pressing surface 108 is exposed from the inserting and detaching hole 9. When the cover 11 is attached to the main body 2, the protrusion 12 of the cover 11 is inserted in the inserting and detaching hole 9. At that time, the protrusion 12 slides on the pressing surface 108 and the roller holder 101 rotates in the anti-forcing direction (the direction toward the inner side from the outer side). Based on this rotation of the roller holder 101, the platen roller 102 is pressed to the thermal head H. Each of tapes in the tape cassette C are sandwiched between the platen roller 102 and the thermal head H. Here, each of tapes in the tape cassette C means a print tape 211 and an ink ribbon 206. On the other hand, when the cover 11 is removed from the main body 2, the protrusion 12 of the cover 11 is detached and released from the inserting and detaching hole 9. At that time, since the protrusion 12 is left from the pressing surface 108, the roller holder 101 rotates toward the forcing direction (the direction toward the outer side from the inner side of the cassette accommodation part 8). Based on this rotation of the roller holder 101, the platen roller 102 is left from the thermal head H.

Around the cassette accommodation part 108, a pair of first engagement hole 6A, 6B and a second engagement hole 7 are formed. When the cover 11 is attached to the main body 2, each of first engagement hooks (not shown) of the cover 11 are respectively hooked with each of the first engagement holes 6A, 6B.

Similarly, when the cover 11 is attached to the main body 2, the second engagement hole 7 is mutually hooked with the second engagement hook 14 of the cover 11. Therefore, under a state that the cover 11 is attached to the main body 2, when a user pushes the second engagement hook 14, the second engagement hook 14 comes off from the second engagement hole 7. Thereby, the cover 11 can be detached from the main body 2.

[3. Outline Construction of Tape Cassette]

Figure 6:
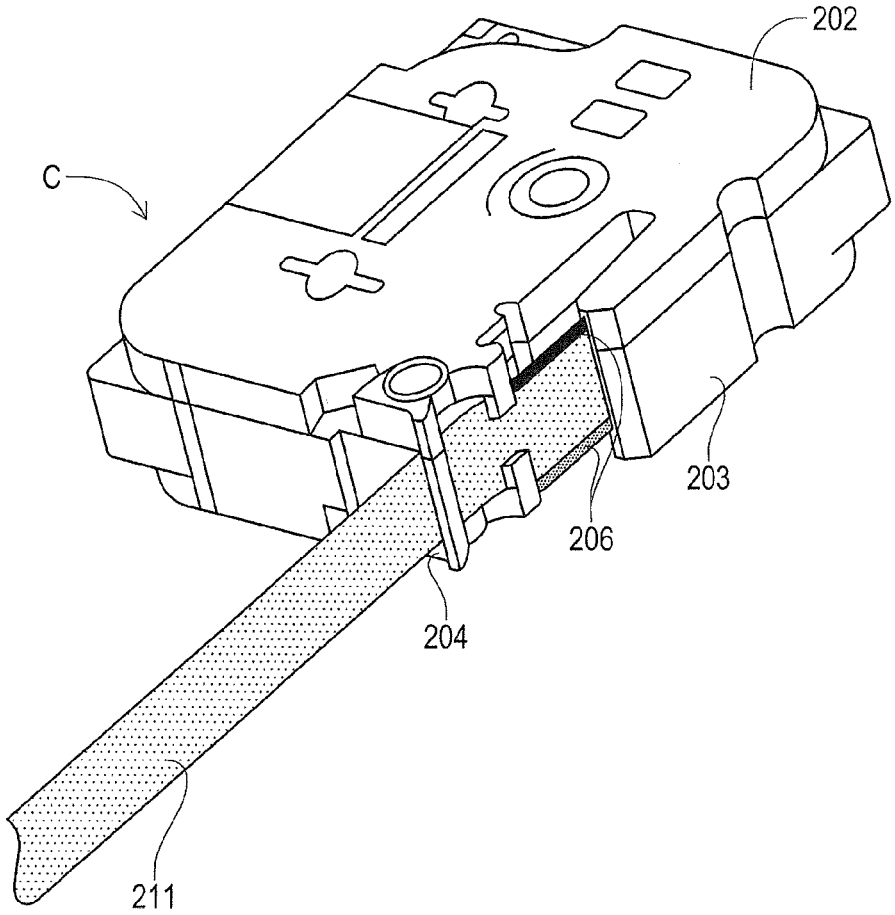
FIG. 6 is a perspective view showing the tape cassette.

Next, it will be described the tape cassette C for forming the self-laminating printed label, according to the embodiment of the present disclosure. The tape cassette C is set in the above tape printer 1. The tape cassette C of the embodiment is classified as a receptor-type tape cassette. As shown in FIG. 6, the tape cassette C has an upper cassette case 202 and a lower cassette case 203. In the tape cassette C of the embodiment, a print tape 211 is exhausted from a tape exhausting portion 204. Here, the numeral 206 represents the ink ribbon.

Figure 7:
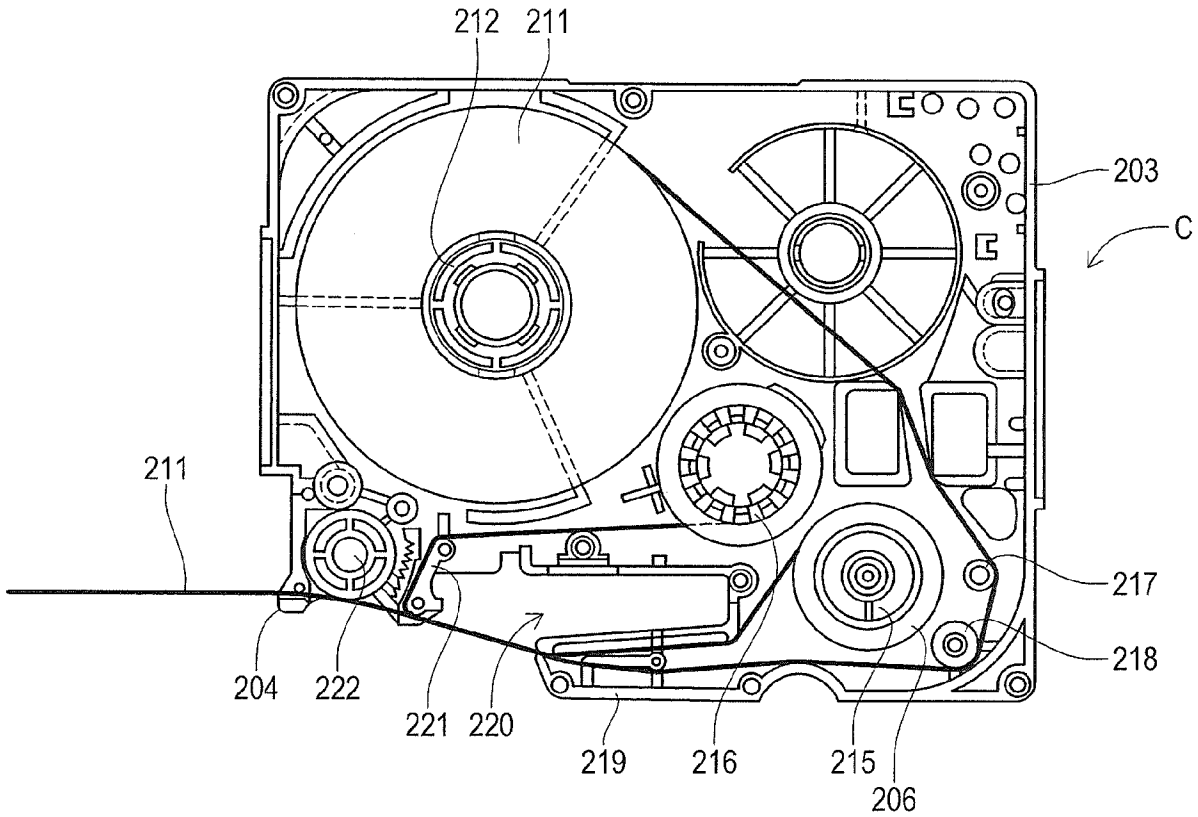
FIG. 7 is a plan view of the tape cassette showing a state that an upper cassette case is removed.

In FIG. 7, within the lower cassette case 203 of the tape cassette C, a tape spool 212, a ribbon supply spool 215 and a ribbon winding spool 216 are rotatably arranged in cooperation with each of spool support portions (not shown). Around the tape spool 212, the print tape 211 is wound. Around the ribbon supply spool 215, the ink ribbon 206 is wound. Each of the spool support portions is formed on a lower surface of the upper cassette case 202 (see FIG. 6).

The print tape 211 is wound around the tape spool 212 with the print part and the release sheet inwardly. Here, the print part corresponds to an image receiving layer 1033 shown in FIG. 10. The release sheet is indicated by the numeral 1035 in FIG. 10. Detail explanation of the print tape 211 will be described hereinafter.

The print tape 211 is wound around the tape spool 212. The wound print tape 211 is guided to an arm portion 219 while being guided through a guide pin 217 and a guide roller 218. The guide pin 217 is formed upward on the lower cassette case 203. The guide roller 218 is made rotatable. The arm portion 219 is formed in the lower cassette case 203. Further, the print tape 211 is exposed at an outer side of the arm portion 219 and in a thermal head positioning part 220. Thereafter, the print tape 211 is exhausted outside of the tape cassette C from the tape exhausting portion 204 via a guide member 221 and a feeding roller 222.

The ink ribbon 206 is wound around the ribbon supply spool 215 with an ink coated surface inwardly. The wound ink ribbon 206 is exposed at the outer side of the arm portion 219 and in the thermal head positioning part 220. The exposed ink ribbon 206 is guided so that the ink coated surface is overlapped with the print part of the print tape 211. Thereafter, the ink ribbon 206 is guided along an outside of the guide member 221. Thereby the ink ribbon 206 is left from the print part of the print tape 211. Further, the ink ribbon 206 is wound around the ribbon winding spool 216.

Figure 8:
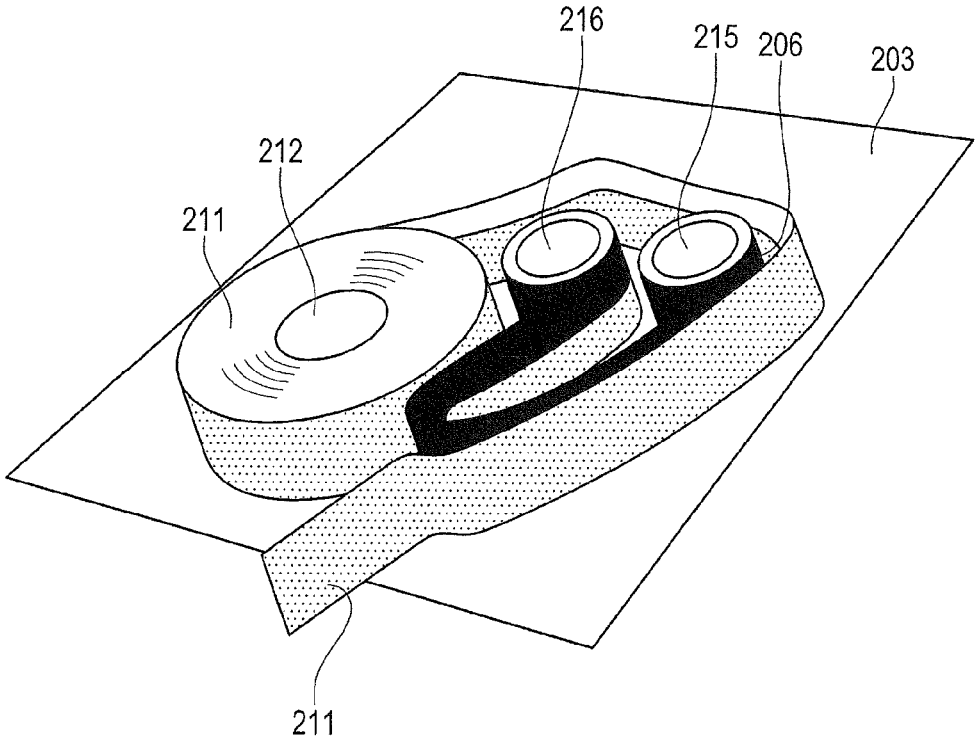
FIG. 8 is a schematic view showing a process that the print tape and the ink ribbon according to the embodiment of the present disclosure are guided on a lower cassette case.

Therefore, the print tape 211, on which characters are printed in the print part, is exhausted from the tape exhausting portion 204 of the tape cassette C. Here, as mentioned in the above, the print tape 211 and the ink ribbon 206 are guided on the lower cassette case 203. The outline of this guiding process is indicated in FIG. 8.

Namely, the tape cassette C is set on the cassette accommodation part 8 of the tape printer 1. In the tape cassette C set according to the above, the print tape 211 is exhausted from the tape exhausting portion 204, after characters are printed on the print part. The exhausted print tape 211 is cut by pressing the cutter lever 5 of the tape printer 1. By this cutting of the print tape 211, the print tape 211 becomes the self-laminating printed label 301.

Hereinafter, the ink ribbon 206 and the print tape 211 will be described. The ink ribbon 206 and the print tape 211 are accommodated in the tape cassette C.

[4. Ink Ribbon]

Figure 9:
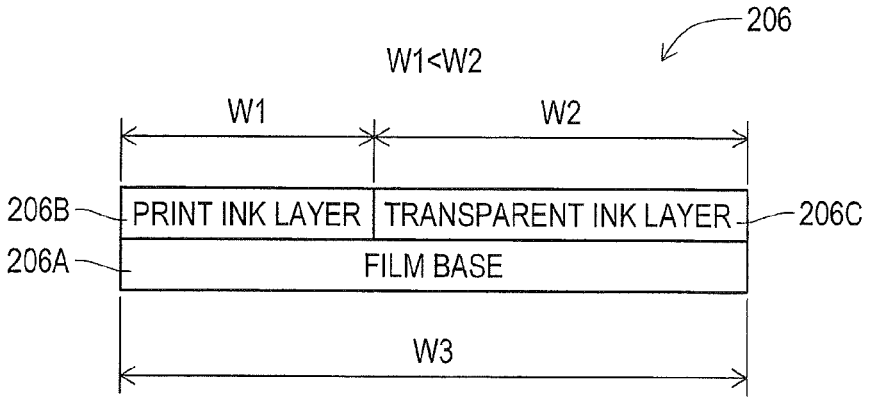
FIG. 9 is a schematic view showing a side surface of the ink ribbon.
Figure 11:
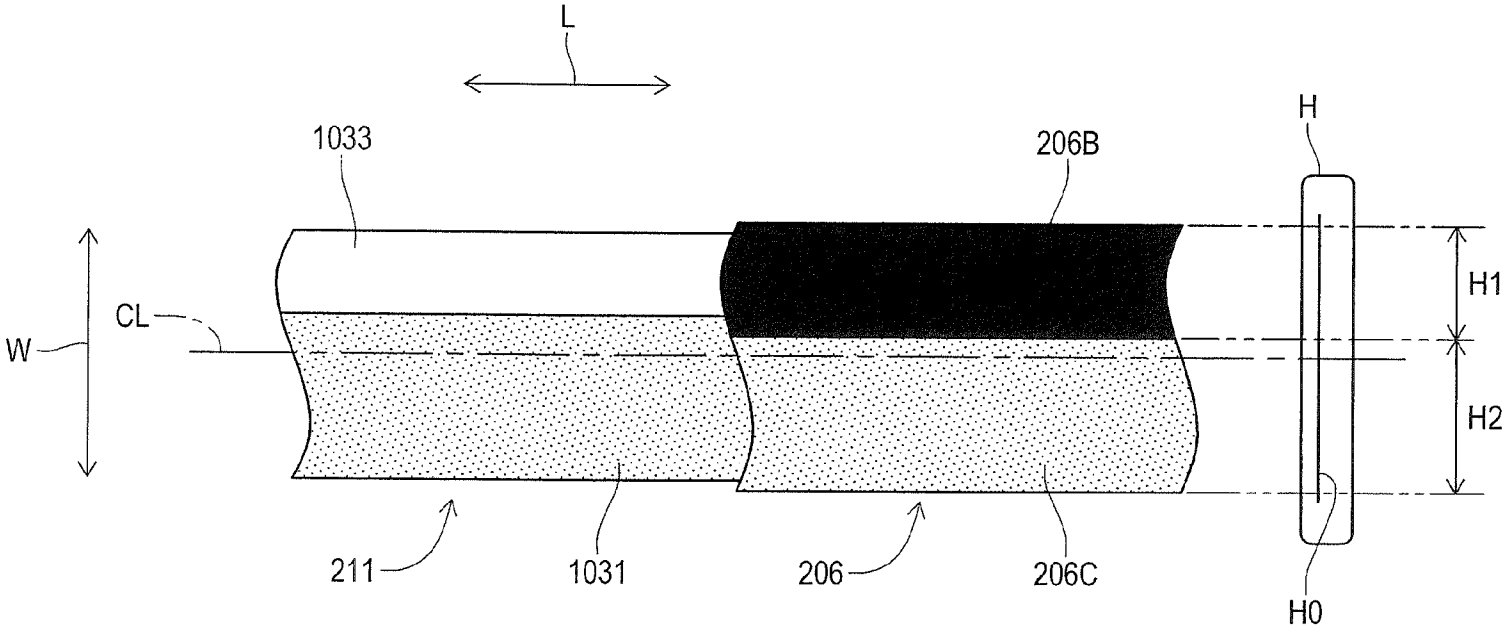
FIG. 11 is an explanatory view showing a positional relation among the print tape, the ink ribbon and the thermal head.

The ink ribbon 206 according to the embodiment will be explained. As shown in FIGS. 9 and 11, in the ink ribbon 206 of the embodiment, a print ink layer 206B and a transparent ink layer 206C are coated on a film base 206A. The print ink layer 206B is arranged adjacent to the transparent ink layer 206C along the longitudinal direction L, on the film base 206A.

The width W2 of the transparent ink layer 206C is larger than the width W1 of the print ink layer 206B in the width direction.

[5. Print Tape]

Figure 10:
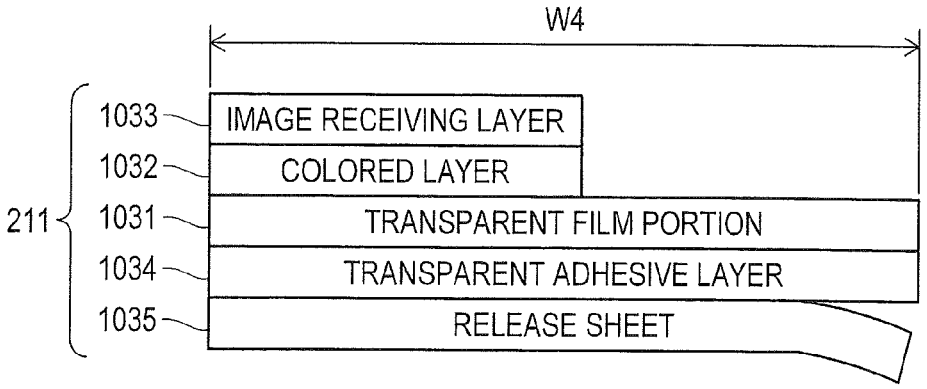
FIG. 10 is a schematic view showing a side surface of the print tape.

Next, the print tape 211 will be described. As shown in FIGS. 10 and 11, the longitudinal print tape 211 has a transparent film portion 1031, a colored layer 1032, the image receiving layer 1033, a transparent adhesive layer 1034 and the release sheet 1035.

Here, on the first end side (left side in the FIG. 10/upper side in FIG. 11) in the width direction W of the first surface (upper surface in FIG. 10) on the transparent film portion 1031, the colored layer 1032 is coated. The image receiving layer 1033 is coated on the colored layer 1032.

On the other hand, under the second surface (lower surface in FIG. 10) opposite to the first surface (upper surface in FIG. 10) of the transparent film portion 1031, the transparent adhesive layer 1034 is coated. The release sheet 1035 is adhered to the transparent adhesive layer 1034. Therefore, when the release sheet 1035 is released from the print tape 211, the transparent adhesive layer 1034 is exposed.

Here, the width W4 of the print tape 211 is shorter than the width W3 (see FIGS. 6 and 9) of ink ribbon 206. In the print tape 211, the width of the image receiving layer 1033 and the colored layer 1032 is set an approximate 1/3 width of the width W4 of the transparent film portion 1031.

The image receiving layer 1033 is positioned on the first end side (left side in FIG. 10/upper side in FIG. 11) in the width direction W of the first surface (upper surface in FIG. 10) of the transparent film portion 1031. Against the image receiving layer 1033, the opaque ink of the print ink layer 206B is transferred from the ink ribbon 206. This transferring is conducted based on that the line-head portion H1 of the line-head HO in the thermal head H contacting with the print ink layer 206B through the film base 206A is heated.

Furthermore, at the second end side (right side in FIG. 10/lower side in FIG. 11) opposite to the first end side (left side in FIG. 10/ upper side in FIG. 11) of the transparent film portion 1031, the transparent ink of the transparent ink layer 206C is transferred. This transferring is conducted based on that the line-head portion H2 of the line-head HO in the thermal head H contacting with the transparent ink layer 206C through the film base 206A is heated.

At that time, in the line-head HO, energy same as that added to the line-head portion H1 is also added to the line-head portion H2.

Here, the transparent ink of the transparent ink layer 206C is transferred on the transparent film portion 1031 of the print tape 211 from the ink ribbon 206. Such transparent ink is invisible on the transparent film portion 1031. On the contrary, the opaque ink of the print ink layer 206B is transferred on the image receiving layer 1033 of the print tape 211. Such opaque ink is visible on the image receiving layer 1033. Especially, the opaque ink on the image receiving layer 1033 becomes clearly visible by the colored layer 103.

Therefore, the print tape 211 can be used as the self-laminating printed tape. In a case that the print tape 211 is used as the self-laminating printed tape, the image receiving layer 1033 of the print tape 211 corresponds to the print portion 302 of the self-laminating printed label 301 (see FIG. 1). The transparent film portion 1031 of the print tape 211 corresponds to the transparent film portion 303 of the self-laminating printed label 301 (see FIG. 1).

[6. Summary]

That is to say, in the embodiment, the tape cassette C is set in the tape printer 1. The tape cassette C has the ink ribbon 206 and the print tape 211. In the ink ribbon 206, the print ink layer 206B and the transparent ink layer 206C are coated on the film base 206A along the longitudinal direction L thereof. The opaque ink of the print ink layer 206B and the transparent ink of the transparent ink layer 206C are transferred on the first surface (upper surface in FIG. 10) of the transparent film portion 1031 from the ink ribbon 206, by the thermal head H in the tape printer 1.

At that time, the opaque ink of the print ink layer 206B is transferred on the first end side (left side in FIG. 10/ upper side in FIG. 11) in the width direction W of the first surface (upper surface in FIG. 10) of the transparent film portion 1031 from the ink ribbon 206. At the same time, the transparent ink of the transparent ink layer 206C is transferred on the second end side (right side in FIG. 10/lower side in FIG. 11) opposite to the first end side of the transparent film portion 1031 from the ink ribbon 206.

Further, when the above transferring is conducted, the ink ribbon 206 is once adhered to the print tape 211, thereafter the ink ribbon 206 is torn off from the print tape 211. Due to this tearing off, force occurs. This force affects the print tape 211 and the ink ribbon 206. However, in the embodiment, the above transferring is conducted on the first end side (left side in FIG. 10/ upper side in FIG. 11) in the width direction W of the first surface (upper surface in FIG. 10) of the transparent film portion 1031 and the second end side (right side in FIG. 10/ lower side in FIG. 11) opposite to the first end side (left side in FIG. 10/ upper side in FIG. 11).

Therefore, the force occurring due to tearing off uniformly acts for the print tape 211 and the ink ribbon 206. Thus, when the print tape 211 and the ink ribbon 206 are fed in the longitudinal direction within the tape cassette C, vibration of the print tape 211 and the ink ribbon 206 in the width direction W can be suppressed.

Accordingly, in the embodiment, feed characteristic of the ink ribbon in the tape cassette C can be stably retained.

[7. Others]

The present disclosure is not limited by the above embodiment and various modifications can be done within a scope of the disclosure.

For example, a transparent pattern and a print pattern may be formed with the linear symmetrical relation, by setting the symmetrical axis to the central line CL (see FIG. 11) in the width direction of the ink ribbon 206.

Here, the transparent pattern is a pattern according to which the transparent ink of the transparent ink layer 206C is transferred on the print tape 211 from the ink ribbon 206. The print pattern is a pattern according to which the opaque ink of the print ink layer 206B is transferred on the print tape 211 from the ink ribbon 206. In this case, the force occurring due to tearing off acts more uniformly in the width direction W for the print tape 211 and the ink ribbon 206. As a result, when the print tape 211 and the ink ribbon 206 are fed in the longitudinal direction in the tape cassette C, vibration of the print tape 211 and the ink ribbon 206 in the width direction W can be suppressed more effectively.

Further, in the print tape 211, the image receiving layer 1033 can be omitted. In this case, the opaque ink of the print ink layer 206B is transferred on the colored layer 1032 of the print tape 211 from the ink ribbon 206.

Furthermore, in the ink ribbon 206, the print ink layer 206B and the transparent ink layer 206C may be formed in the longitudinal direction with a longitudinal space between the print ink layer 206B and the transparent ink layer 206C.

The tape cassette C may be used in the laminating type cassette in addition to the receptor type cassette.

While the presently exemplary embodiment has been shown and described, it is to be understood that this disclosure is for the purpose of illustration and that various changes and modifications may be made without departing from the scope of the disclosure as set forth in the appended claims.

What is claimed is:

1. A tape printer with a thermal head and a tape cassette for forming a self-laminating printed label, wherein the tape cassette comprises:

an ink ribbon including a print ink layer formed from opaque ink, a transparent ink layer formed from transparent ink and a longitudinal film base, the print ink layer and the transparent ink layer being coated on the film base in a longitudinal direction of the film base; and a print tape including a longitudinal transparent film portion with a first surface side and a second surface side opposite to the first surface side, the opaque ink of the print ink layer and the transparent ink of the transparent ink layer being transferred to the first surface side of the transparent film portion from the ink ribbon, wherein, in the print tape, a transparent adhesive layer is coated on the second surface side of the transparent film portion, the opaque ink of the print ink layer is transferred on a first end side of the first surface side of the transparent film portion in a width direction from the ink ribbon and the transparent ink of the transparent ink layer is transferred on a second end side of the transparent film portion opposite to the first end side from the ink ribbon, and wherein the thermal head operates to transfer both the opaque ink of the print ink layer and the transparent ink of the transparent ink layer on the print tape from the ink ribbon.

2. The tape printer according to claim 1, wherein the print tape includes a release sheet adhered on the transparent adhesive layer.

3. The tape printer according to claim 1, wherein a width of the ink ribbon is larger than a width of the print tape in the tape cassette.

4. The tape printer according to claim 1, wherein the thermal head of the tape printer applies first energy to the print ink layer and second energy equal to the first energy applied to the print ink layer to the transparent ink layer.

5. The tape printer according to claim 4, wherein the opaque ink of the print ink layer is transferred to the print tape from the ink ribbon via a print pattern by applying the first energy to the print ink layer, wherein the transparent ink of the transparent ink layer is transferred to the print tape from the ink ribbon via a transparent pattern by applying the second energy to the transparent ink layer, and wherein the print pattern and the transparent pattern has a linear symmetrical relation when setting a central line in a width direction of the ink ribbon to a symmetrical axis.

6. A tape cassette for forming a self-laminating printed label, the tape cassette being set in a tape printer, the tape cassette comprising:

an ink ribbon including a print ink layer formed from opaque ink, a transparent ink layer formed from transparent ink and a longitudinal film base, the print ink layer and the transparent ink layer being coated on the film base in a longitudinal direction of the film base; and a print tape including a longitudinal transparent film portion with a first surface side and a second surface side opposite to the first surface side, the opaque ink of the print ink layer and the transparent ink of the transparent ink layer being transferred to the first surface side of the transparent film portion from the ink ribbon, wherein, in the print tape, a transparent adhesive layer is coated on the second surface side of the transparent film portion, the opaque ink of the print ink layer is transferred on a first end side of the first surface side of the transparent film portion in a width direction from the ink ribbon and the transparent ink of the transparent ink layer is transferred on a second end side of the transparent film portion opposite to the first end side from the ink ribbon.

7. The tape cassette according to claim 6, the tape cassette further comprising:

a first cassette case;

a second cassette case;

a release sheet adhered on the transparent adhesive layer;

a tape spool around which the print tape is wound;

a ribbon supply spool around which the ink ribbon is wound;

wherein the tape spool and the ribbon supply spool are provided on the second cassette case, and wherein a first end side in a width direction of the print ink layer is arranged at a position opposite to the first cassette case.

8. The tape cassette according to claim 7, wherein the ink ribbon is wound around the ribbon supply spool with the print ink layer and the transparent ink layer inwardly.

9. The tape cassette according to claim 8, wherein the print tape is wound around the tape spool with the release sheet inwardly.

10. The tape cassette according to claim 7, wherein the print tape includes a colored layer coated on the first surface side of the transparent film portion, and wherein a first end side in a width direction of the colored layer is arranged at a position opposite to the first cassette case.

11. The tape cassette according to claim 10, wherein the print tape includes an image receiving layer coated on the colored layer.

12. An ink ribbon accommodated in a tape cassette for forming a self-laminating printed label, the ink ribbon comprising:

a print ink layer formed from opaque ink;

a transparent ink layer formed from transparent ink; and a longitudinal film base;

wherein the print ink layer and the transparent ink layer are coated on the film base along a longitudinal direction of the film base, and wherein a width of the transparent ink layer is larger than a width of the print ink layer.

* * * * *